US006213251B1

(12) United States Patent
Kesselring

(10) Patent No.: US 6,213,251 B1
(45) **Date of Patent: *Apr. 10, 2001**

(54) SELF-TUNING EXHAUST MUFFLER

(76) Inventor: Stephen H. Kesselring, 1330 McArdle Rd., Dothan, AL (US) 36303

( * ) Notice: Subject to any disclaimer, the term of this patent is extended or adjusted under 35 U.S.C. 154(b) by 0 days.

This patent is subject to a terminal disclaimer.

(21) Appl. No.: 09/166,320

(22) Filed: Oct. 5, 1998

Related U.S. Application Data

(63) Continuation of application No. 08/936,351, filed on Sep. 24, 1997, now Pat. No. 5,831,223.

(51) Int. Cl.[7] ..... F01N 1/02

(52) U.S. Cl. ..... 181/249; 181/255; 181/227; 181/279

(58) Field of Search ..... 181/227, 228, 181/238, 239, 249, 250, 251, 255, 267, 269, 275, 279, 280, 282

(56) References Cited

U.S. PATENT DOCUMENTS

| | | | | |
|---|---|---|---|---|
| 2,300,130 | | 1/1942 | McCurdy . | |
| 2,570,728 | | 10/1951 | Storey . | |
| 3,752,260 | * | 8/1973 | Heath | 181/227 |
| 3,977,493 | | 8/1976 | Richardson . | |
| 4,149,611 | | 4/1979 | Taguchi . | |
| 4,234,054 | | 11/1980 | Chapin . | |
| 4,263,982 | | 4/1981 | Feuling . | |
| 4,589,515 | | 5/1986 | Omura . | |
| 4,595,073 | | 6/1986 | Thawani . | |
| 4,683,978 | | 8/1987 | Venter . | |
| 4,690,245 | | 9/1987 | Gregorich et al. . | |
| 4,705,138 | | 11/1987 | Reese . | |
| 4,715,472 | | 12/1987 | McKee . | |
| 4,792,014 | * | 12/1988 | Shin-Seng | 181/255 |
| 5,109,950 | | 5/1992 | Lescher . | |
| 5,152,366 | | 10/1992 | Reitz . | |
| 5,183,976 | | 2/1993 | Plemons, Jr. . | |
| 5,246,473 | * | 9/1993 | Harris | 181/228 |
| 5,633,482 | | 5/1997 | Erion et al. . | |
| 5,902,970 | * | 5/1999 | Ferri | 181/252 |
| 6,006,859 | * | 12/1999 | Hussaini | 181/227 |

FOREIGN PATENT DOCUMENTS

| | | |
|---|---|---|
| 1226438 | 11/1960 | (FR) . |
| 286234 | 2/1953 | (SE) . |

* cited by examiner

*Primary Examiner*—Khanh Dang
(74) *Attorney, Agent, or Firm*—Brown & Michaels, P.C.

(57) ABSTRACT

An exhaust muffler for a motor vehicle includes a louver tube having an intake end and an exhaust end. An outer tube, consisting of a frustoconical portion and a cylindrical portion, is concentrically arranged around the louver tube. A plurality of louvers and associated louver holes in the louver tube scoop a portion of gasses from the louver tube into the outer tube. An end cap, which includes an exhaust exit hole in its center, fits into an exhaust end of the outer tube. A plurality of end cap holes are arranged so that gasses leaving the outer tube flow through them. A restrictor disk between the end cap and louver tube includes a central hole coaxial with the louver tube and the exhaust exit hole of the end cap. Restrictor disk holes are in the restrictor disk between the central hole and its perimeter so that gasses leaving the louver tube flow through the central hole and the restrictor disk holes as they leave the muffler. A spiral vane defining a helical passage around the louver tube and inside the outer tube extends the path length of the gasses in the outer tube. A series of fins on the spiral vane extend orthogonal to an axis of the louver tube. A series of inner reverse cones are inside the louver tube upstream of its exhaust end. An exhaust system with this muffler is characterized by moderate backpressure at low rpms and little or negative backpressure at high rpms.

16 Claims, 8 Drawing Sheets

SELF-TUNING EXHAUST MUFFLER

This application is a continuation of application Ser. No. 08/936,351 filed Sep. 24, 1997, now U.S. Pat. No. 5,831, 223.

FIELD OF THE INVENTION

The invention pertains to the field of exhaust mufflers. More particularly, the invention pertains to a self-tuning exhaust muffler for a motor vehicle, and especially a motorcycle, that reduces the sound with minimal reduction in engine torque.

BACKGROUND OF THE INVENTION

A muffler is a device used to attenuate sound propagated in conjunction with a moving stream of fluid, usually a gas. Mufflers generally fall into two categories depending on how the sound energy is removed from the gas stream: reactive and dissipative. A reactive muffler, also known as a nondissipative muffler, attenuates the sound energy by reflecting the sound back toward the source. A dissipative muffler absorbs the sound energy as the gas passes through the muffler. Design considerations for the acoustical performance of a motor vehicle muffler include: (1) the required sound attenuation as a function of frequency and length, (2) the effect on the exhaust gas flow and resulting system backpressures, and (3) the economics of manufacturing and installation.

The disadvantages of dissipative mufflers are numerous. Unburned carbon particles tend to close the pores of sound absorbing materials lining the walls of the muffler. The high velocity unsteady flow of exhaust gasses blows out the fibers of the absorptive lining. Thermal cracking of the linings frequently occurs. There is poor attenuation at low frequencies, i.e., on the order of the firing frequency, where most of the exhaust noise is concentrated. Finally, there are relatively higher manufacturing costs as compared with a reactive muffler.

Most of the noise from a motor vehicle engine is at the firing frequency and the first few harmonics. Exhaust noise from motor vehicles generally consists of (1) sound generated when combustion gasses leave the engine manifold and (2) sound generated when the exhaust gasses flows through the exhaust pipe. The first sound is in the form of pulsating pressure waves that include frequency components proportional to the engine speed. The first sound therefore has a relatively large amount of low frequency components. The second sound has a relatively large amount of high frequency components. Low frequency noise components are easily muffled with a modest size muffler. Motorcycles present a challenge to the noise engineer due to the limited muffler space available.

Motor vehicle mufflers are predominantly of the reactive type. Reflection is provided through acoustic filters, resonators, and changes in direction caused by bends in the pipe containing the gas stream. Reactive mufflers are useful in low frequency applications where the high temperatures or flammable exhaust gasses restrict the use of dissipative materials. A primary characteristic of reactive mufflers is a relatively high pressure drop for a given value of gas flow velocity. This pressure drop exhibits itself as a back pressure at the exhaust of the engine, thereby restricting the engine performance. Back pressure is the extra static pressure exerted by the muffler on the engine through restriction in the flow of exhaust gasses.

Conventionally, the muffler volume is proportional to the engine piston displacement and inversely proportional to the engine speed and square root of the engine cylinders. This can be represented as:

$$\mathrm{Vol} = \frac{(K)(\text{displacement})}{\text{rpm}\sqrt{\text{no. of cylinders}}},$$

where K values range from 5,000 for farm tractors, 1,000 for off-highway trucks and heavy equipment, 35,000 for highway trucks, up to 50,000 for passenger cars.

The fundamental frequency of piston-engine exhaust noise in the exhaust line is the product of the number of cylinders firing per revolution and the engine speed, assuming the exhaust manifold has a center outlet. If the exhaust manifold has an end outlet instead of a center outlet, the frequency is reduced by half. For example, a 6 cylinder 4-stroke cycle engine operating at 3,000 rpm has a fundamental exhaust frequency of (6/2)(3,000/60)=150 Hz. The critical length of the exhaust pipe depends on the fundamental exhaust frequency and the mean temperature of the exhaust gasses. The critical length is $\lambda/2$ and all integer multiples of $\lambda/2$ (harmonics), where $\lambda$ is the wavelength of the sound in the exhaust pipe An exhaust muffler of the critical length sets up a standing wave with maximum pressure at the exhaust valves and minimum pressure at the end of the exhaust pipe. Assuming that the exhaust gas temperature in the exhaust pipe is such that the velocity of sound is 1,500 fps, then the critical length of this engine is ½ of 1,500/150=5 feet. Thus, 5 feet, 10 feet, etc. are critical lengths for exhaust lines in this engine.

The usual length to diameter ratio, l/d, is about 4:1, but can be as high as 8:1 in straight-through mufflers. A small l/d ratio muffler attenuates the sound well for a narrow frequency band, whereas a large l/d ratio muffler attenuates the sound over a wider frequency band but not as well.

Exhaust noise is appreciably reduced by filtering (friction effects) and using resonance chambers to offset the noise-wave effects. The total aeroacoustic attenuation in a moving medium (exhaust gasses) is a sum of the viscothermal effects and turbulent flow friction. A simple expansion chamber 1 in a muffler 9 as shown in FIG. 1A is effective for one relatively low noise frequency. Some friction is also present due to a relatively small exit hole 2 in an exit plate 3. FIG. 1B shows a baffle muffler 9 with control holes 4 in each baffle 5 that introduce friction effects. A plurality of chambers 6 are resonance chambers which have a very high frequency and are effective for filtering a narrow band of high sound frequencies. FIG. 1C shows a straight-through muffler which has one resonating chamber 7 connected to a central perforated pipe with a plurality of perforation holes 8 but no baffles or associated friction effects. FIGS. 1D and 1E show combinations of baffles 5 and resonator chambers 7. FIG. 1F shows four resonator chambers 7 of different frequencies which depend on the ratio of perforation area from perforation holes 8 to resonator volume. The higher this ratio, the higher the frequencies that are attenuated.

In general, torque is the ability of an engine to gain rpms, while horsepower is how much power the engine produces at a given rpm. Increasing backpressure increases torque in the low to mid-range rpms. After that, the torque decreases with increased backpressure. However, at mid-range rpms and higher, the horsepower decreases as the backpressure increases. The mid-range rpms thus affect torque and horsepower in different ways. In resistive muffler design, the general tradeoff is that, as surfaces that reflect noise back toward the engine are increased (in order to reduce the noise), the overall back pressure experienced by the system increases. Decreasing the back pressure usually increases the noise. Increased engine backpressure affects the engine timing and power output, as well as increasing unwanted exhaust pollutants.

SUMMARY OF THE INVENTION

Briefly stated, the present invention teaches an exhaust muffler for a motor vehicle includes a louver tube having an intake end and an exhaust end. An outer tube, consisting of a frustoconical portion and a cylindrical portion, is concentrically arranged around the louver tube. A plurality of louvers and associated louver holes in the louver tube scoop a portion of gasses from the louver tube into the outer tube. An end cap, which includes an exhaust exit hole in its center, fits into an exhaust end of the outer tube. A plurality of end cap holes are arranged so that gasses leaving the outer tube flow through them. A restrictor disk between the end cap and louver tube includes a central hole coaxial with the louver tube and the exhaust exit hole of the end cap. Restrictor disk holes are in the restrictor disk between the central hole and its perimeter so that gasses leaving the louver tube flow through the central hole and the restrictor disk holes as they leave the muffler. A spiral vane defining a helical passage around the louver tube and inside the outer tube extends the path length of the gasses in the outer tube. A series of fins on the spiral vane extend orthogonal to an axis of the louver tube. A series of inner reverse cones are inside the louver tube upstream of its exhaust end. An exhaust system with this muffler is characterized by moderate backpressure at low rpms and little or negative backpressure at high rpms.

According to an embodiment of the invention, an exhaust muffler for a motor vehicle includes a louver tube having an intake end and an exhaust end. An outer tube is concentrically arranged around the louver tube, with a frustoconical portion and a cylindrical portion. The frustoconical portion connects to the louver tube at the intake end. A plurality of louvers and associated louver holes are in the louver tube whereby a portion of gasses entering the louver tube are scooped into the outer tube by the louvers through the louver holes. An end cap, with an exhaust exit hole in a center therein whereby gasses leaving the exhaust end of the louver tube flow through the exhaust exit hole, fits into an exhaust end of the outer tube. The end cap also has at least one end cap hole therein whereby gasses leaving the outer tube flow through the end cap hole.

According to an embodiment of the invention, an exhaust muffler for a motor vehicle includes a louver tube having an intake end and an exhaust end. An outer tube is concentrically arranged around the louver tube, with a frustoconical portion and a cylindrical portion. The frustoconical portion connects to the louver tube at the intake end. A plurality of louvers and associated louver holes are in the louver tube whereby a portion of gasses entering the louver tube are scooped into the outer tube by the louvers through the louver holes. An end cap, with an exhaust exit hole in a center therein whereby gasses leaving the exhaust end of the louver tube flow through the exhaust exit hole, fits into an exhaust end of the outer tube. The end cap also has at least one end cap hole therein whereby gasses leaving the outer tube flow through the end cap hole. A restrictor disk is held against the exhaust end of the louver tube by the end cap. The restrictor disk has a central hole therein and at least one restrictor disk hole therein, whereby gasses leaving the exhaust end of the louver tube flow through the central hole and the restrictor disk hole before exiting the exhaust exit hole of the end cap. A spiral vane defines a helical passage around the louver tube and inside the outer tube. At least one inner reverse cone is inside the louver tube upstream of the exhaust end of the louver tube.

DESCRIPTION OF THE PREFERRED EMBODIMENT

Figure 1A:
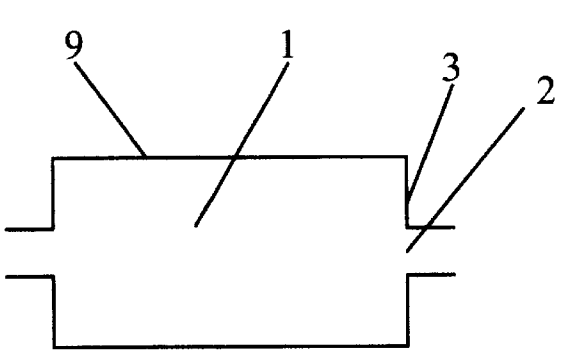
FIG. 1A shows a block diagram of a prior art muffler with a simple expansion chamber.
Figure 1B:
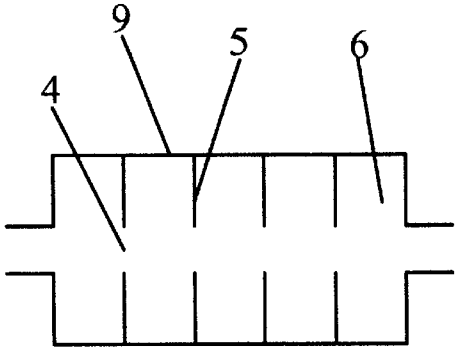
FIG. 1B shows a block diagram of a prior art baffle muffler with control holes centered in each baffle.
Figure 1C:
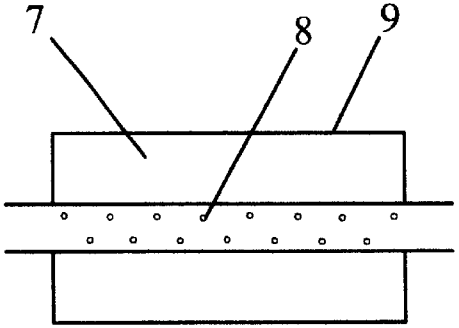
FIG. 1C shows a block diagram of a prior art straight-through muffler with a resonating chamber connected to a central perforated pipe.
Figure 1D:
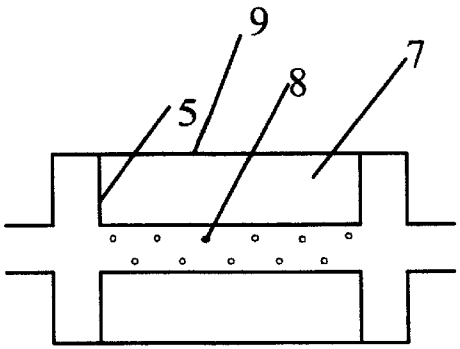
FIG. 1D shows a block diagram of a prior art muffler with a combination of baffles and resonator chambers.
Figure 1E:
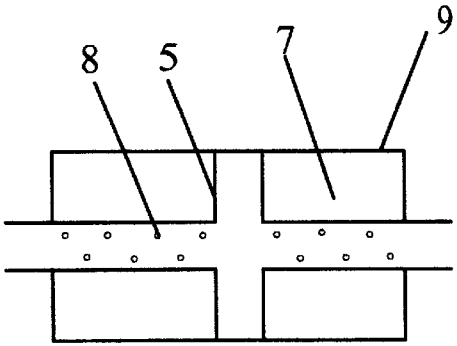
FIG. 1E shows a block diagram of a prior art muffler with a combination of baffles and resonator chambers.
Figure 1F:
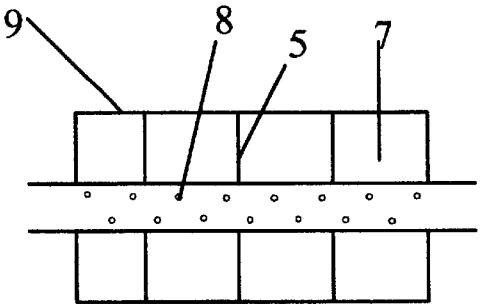
FIG. 1F shows a block diagram of a prior art muffler with four resonator chambers.
Figure 2:
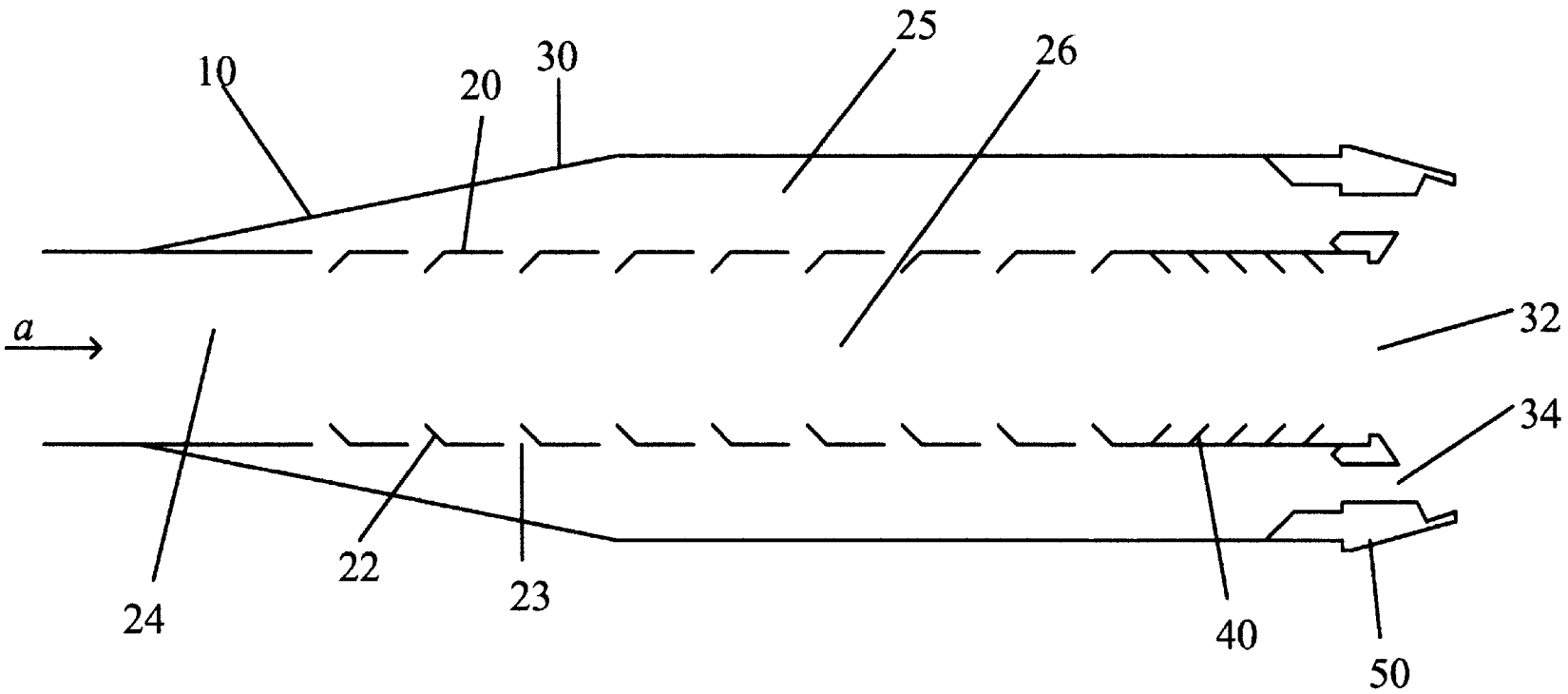
FIG. 2 shows a partial sectional view of an embodiment of the present invention which includes a louver tube, an outer tube, and an end cap.

Referring to FIG. 2, a muffler 10 of the present invention includes an inner tube such as a louver tube 20 and an outer tube 30. Louver tube 20 is preferably formed by punching a plurality of louvers 22 inward into tube 20 so that a plurality of louver holes 23 permit fluid exchange between louver tube 20 and outer tube 30. Outer tube 30 begins as a megaphone shape (frustoconical) and quickly assumes a cylindrical shape. The angle between the frustoconical portion of outer tube 30 and louver tube 20 can be varied to meet the desired performance conditions (sound and backpressure) for the specific design application. The relative lengths of the frustoconical and cylindrical portions can also be varied for the same purpose, as can be the diameter of outer tube 30. Outer tube 30 can be double walled. Outer tube 30 preferably does not contain any dissipative material or other packing.

Exhaust gasses flow in a direction indicated by an arrow a into tube section 24 from an exhaust pipe (not shown)

connected to an exhaust manifold of an engine (not shown). The engine is either an internal combustion engine or a diesel engine. The gasses entering muffler 10 can be characterized as containing a high frequency sound producing portion and a lower frequency portion. The high frequency portion is generated by friction effects while the low frequency portion is related to the firing frequency of the engine. The high frequency portion in this embodiment is caused by and generally concentrated near the outer walls of the pipes or tubes comprising the total exhaust system. The high frequency portion of the gasses entering louver tube 20 are thus deflected by louvers 22 into outer tube 30. A tube chamber 25 acts as an expansion chamber for the gasses entering muffler 10. The low frequency portion remains in the center of louver tube 20 in a tube chamber 26.

As the low frequency portion flows through louver tube 20, high frequency portions are created due to friction effects. These high frequency portions continue to be siphoned off to outer tube 30 via louvers 22. A plurality of inner reverse cones 40 near the far end of louver tube 20 reflect additional high frequency components of the gasses back upstream while slightly constricting the flow of the low frequency portions through the end of louver tube 20, with a consequent slight increase in velocity of the low frequency portion. Inner reverse cones 40 act partly as a choke and partly as a series of baffles. The gasses in louver tube 20 leave muffler 10 through an exhaust exit hole 32. In the embodiment shown for a motorcycle, an end cap 50 connected to the ends of louver tube 20 and outer tube 30 includes a plurality of end cap holes 34 for the gasses in outer tube 30 to exit through.

Figure 3:
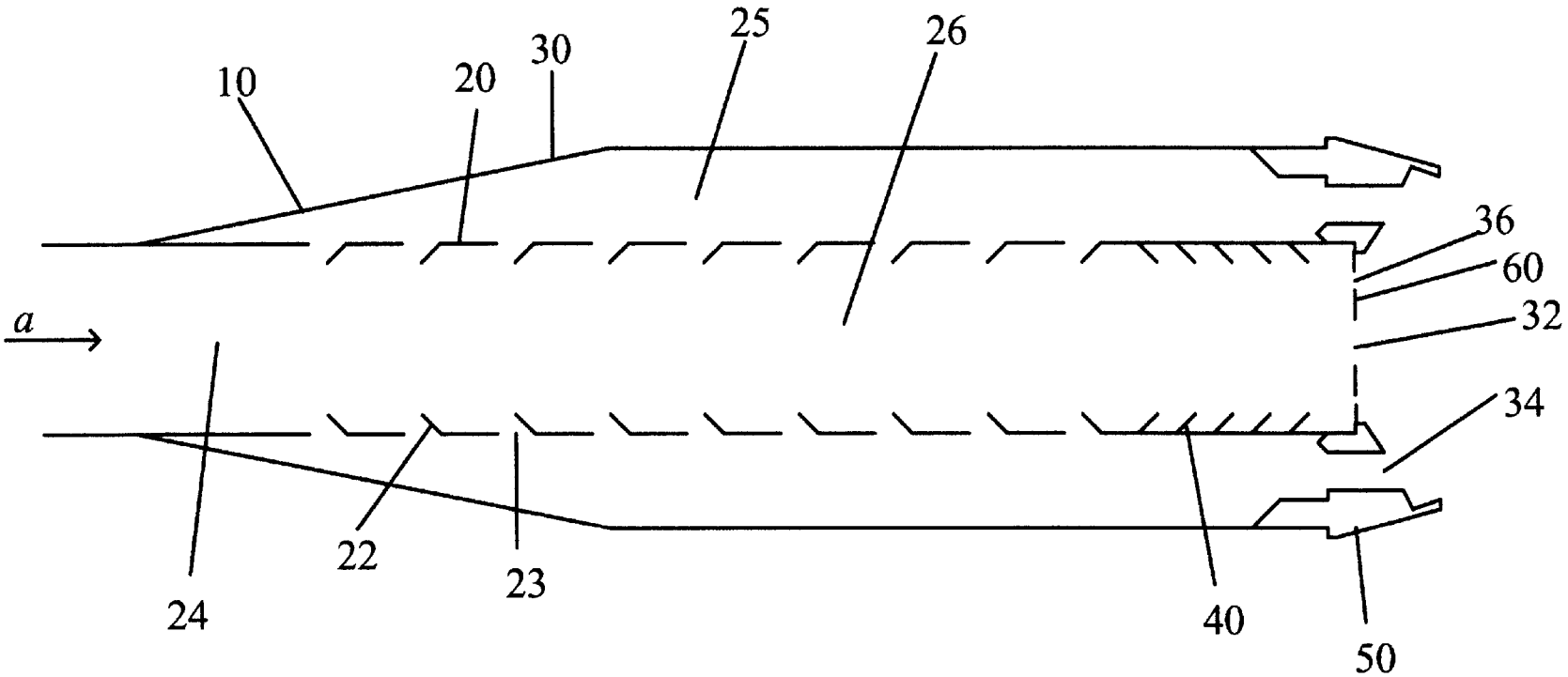
FIG. 3 shows a partial sectional view of an embodiment of the present invention which includes a louver tube, an outer tube, an end cap, and a restrictor disk.

Referring to FIG. 3, an embodiment of the present invention further includes a restrictor disk 60 held in place by end cap 50. Restrictor disk 60 includes a plurality of disk holes 36 in addition to exhaust exit hole 32. A number, size, and shape of disk holes 36 can be varied depending on the engine and other exhaust system parameters to achieve the desired effect (sound and backpressure effect). End cap holes 34 can also be varied in a similar manner.

Figure 4:
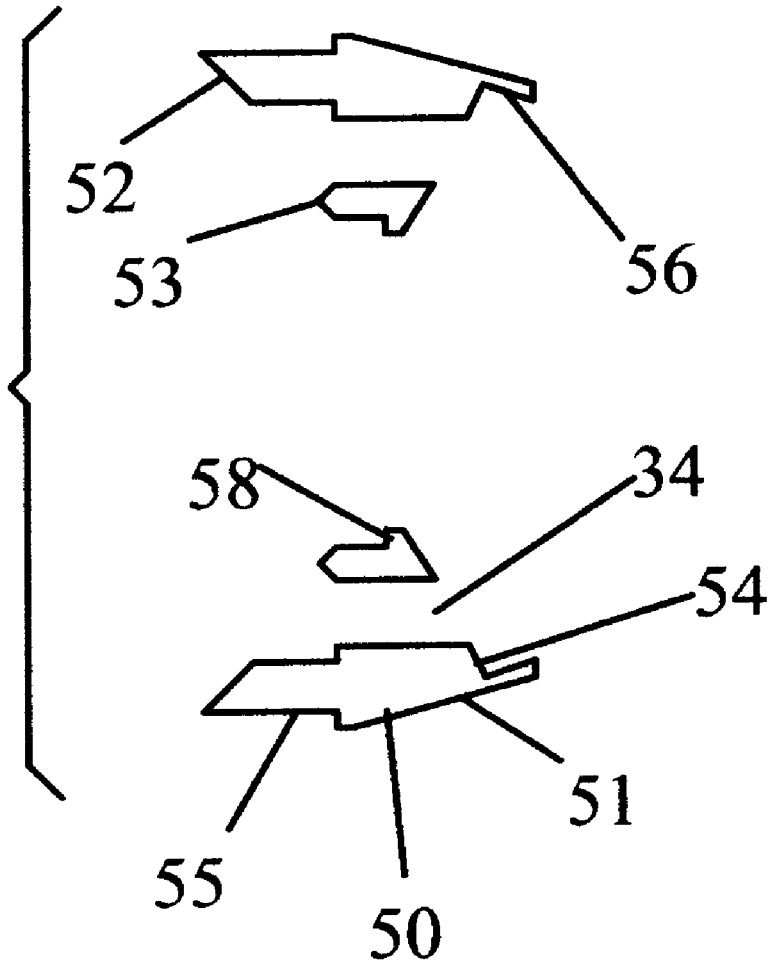
FIG. 4 shows a partial sectional view of the end cap used in the embodiments of FIGS. 2 and 3.

Referring to FIG. 4, end cap 50 includes an edge 55 that is optimally sized to match an inner diameter of outer tube 30. End cap 50 is preferably connected to outer tube 30 by several screws (not shown) extending through outer tube 30 into edge 55. Alternatively, edge 55 is threaded and screws into corresponding threads (grooves) in outer tube 30. The exposed outside diameter of end cap 50 at the upstream end is thus substantially the same as an outer diameter of outer tube 30. A surface 51 is angled, preferably at approximately 30° from an axis of muffler 10, to provide a streamlining effect on the end of the muffler. A lip 56 on end cap 50 in conjunction with a concave edge 54 enhances the streamlining effect of end cap 50.

A length of lip 56 is preferably adjusted depending on the sound and backpressure effect desired for a particular engine and exhaust system. The length of lip 56 changes the diameter of the end of the exhaust system. The longer the length of lip 56, the more the lip restricts the flow and deflects the high frequency sound back into the low frequency sound stream.

Concave edge 54 helps direct the outer flow coming both from the slipstream outside the muffler and from the gasses exiting outer tube 30 back into the inner flow from louver tube 20. The angle concave edge 54 makes with the muffler axis is optionally varied depending on the specific application. Concave edge 54 helps create some back pressure at low rpms and a negative backpressure at high rpms.

A leading edge 52 of end cap 50 is angled to improve the flow characteristic of the gasses in outer tube 30. Leading edge 52 acts as a choke to aid the airflow, and the angle also reflects some of the sound. An angle of leading edge 52 can be at right angles to the muffler axis, but such an angle increases turbulence and backpressure. An angle of 45° C. is preferable. An angled tip 53 of end cap 50 acts in similar fashion to leading edge 52.

Figure 5A:
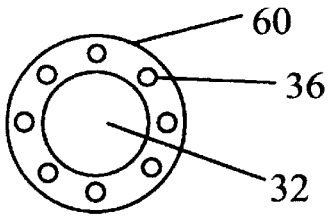
FIG. 5A shows a top view of a restrictor disk with a central hole and a plurality of restrictor disk holes.
Figure 5B:
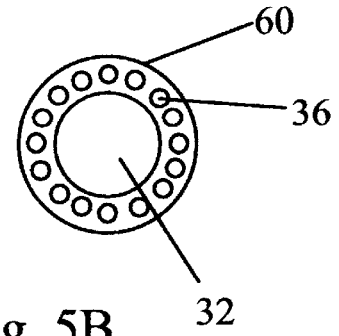
FIG. 5B shows a top view of a restrictor disk with a central hole and a plurality of restrictor disk holes.
Figure 5C:
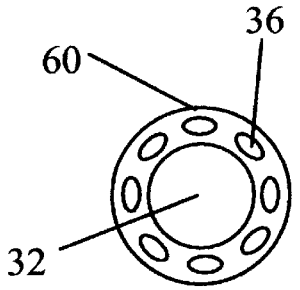
FIG. 5C shows a top view of a restrictor disk with a central hole and a plurality of restrictor disk holes.
Figure 5D:
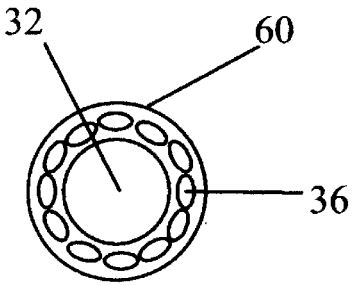
FIG. 5D shows a top view of a restrictor disk with a central hole and a plurality of restrictor disk holes.
Figure 5E:
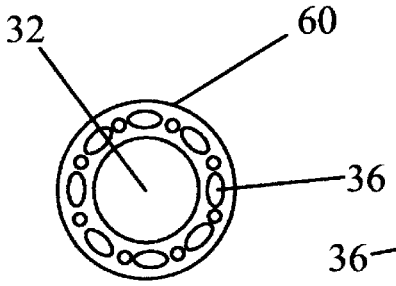
FIG. 5E shows a top view of a restrictor disk with a central hole and a plurality of restrictor disk holes.
Figure 5F:
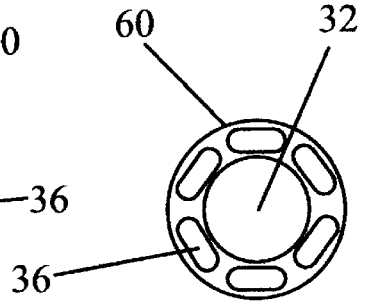
FIG. 5F shows a top view of a restrictor disk with a central hole and a plurality of restrictor disk holes.
Figure 5G:
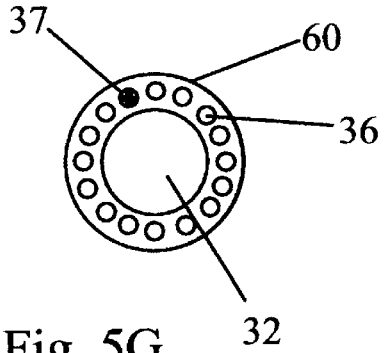
FIG. 5G shows a top view of a restrictor disk with a central hole and a plurality of restrictor disk holes.

Referring to FIGS. 5A–5G, a variety of restrictor disks 60 are shown. The size, shape, and location of restrictor disk holes 36 and exhaust exit hole 60 are optionally varied to achieve the precise performance and sound effect desired. FIG. 5A shows a series of circular disk holes 36 arranged around exhaust exit hole 32. FIG. 5B shows twice as many holes 36 as the embodiment of FIG. 5B. FIG. 5C shows eight elliptically shaped disk holes 36, while FIG. 5D shows sixteen elliptically shaped disk holes 36. FIG. 5E shows eight circular holes 36 interspersed between eight elliptically shaped holes 36. FIG. 5F shows six slot-shaped holes 36. The size and shapes of the holes 36 shown here are illustrative and not limiting. FIG. 5G shows an embodiment in which the holes 36 are threaded so that a person can easily vary the pattern of holes simply by inserting or removing a threaded plug, such as a bolt or screw 37, from the holes 36. The one common feature of the various embodiments of the restrictor disks 60 is that every disk includes an exhaust exit hole 32. That is, the muffler 10 of this invention is not a plug-type muffler.

Figure 6:
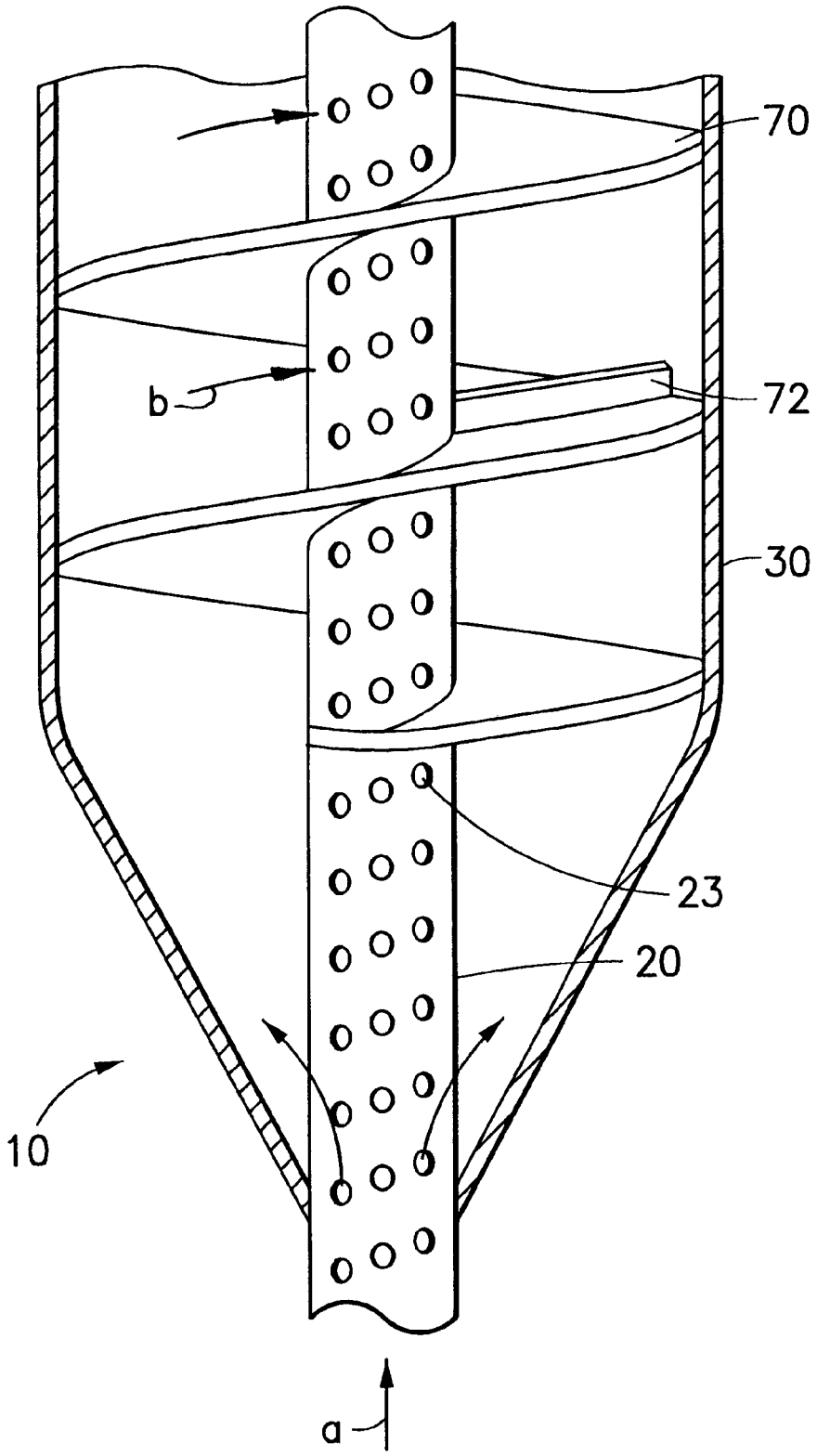
FIG. 6 shows an elevation view of a louver tube with a spiral vane attached to it.

Referring to FIG. 6, an embodiment of the invention includes a spiral 70 attached to louver tube 20 and extending to the inside diameter of outer tube 30. Spiral 70 begins shortly after the first louver holes 23 and extends for at least several spirals along louver tube 20. Some of the exhaust gasses entering louver tube 20 at arrow a are scooped through louver holes 23, thus traveling around spiral 70 inside outer tube 30 as shown by arrow b. An exact length of spiral 70 depends on the specific application the present invention is designed for. Spiral 70 ends before reaching end cap 50. Spiral 70 extends the physical path length of the gasses inside outer tube 30. That is, this embodiment makes use of a multiple length exhaust flow track. Spiral 70 optionally includes a plurality of fins 72 along one or both spiral surfaces which increase the conversion of low frequencies to high frequencies in addition to reflecting the high frequency sound waves. Fins 72 are preferably angled towards the direction the gasses are flowing from, i.e., upstream.

Figure 7:
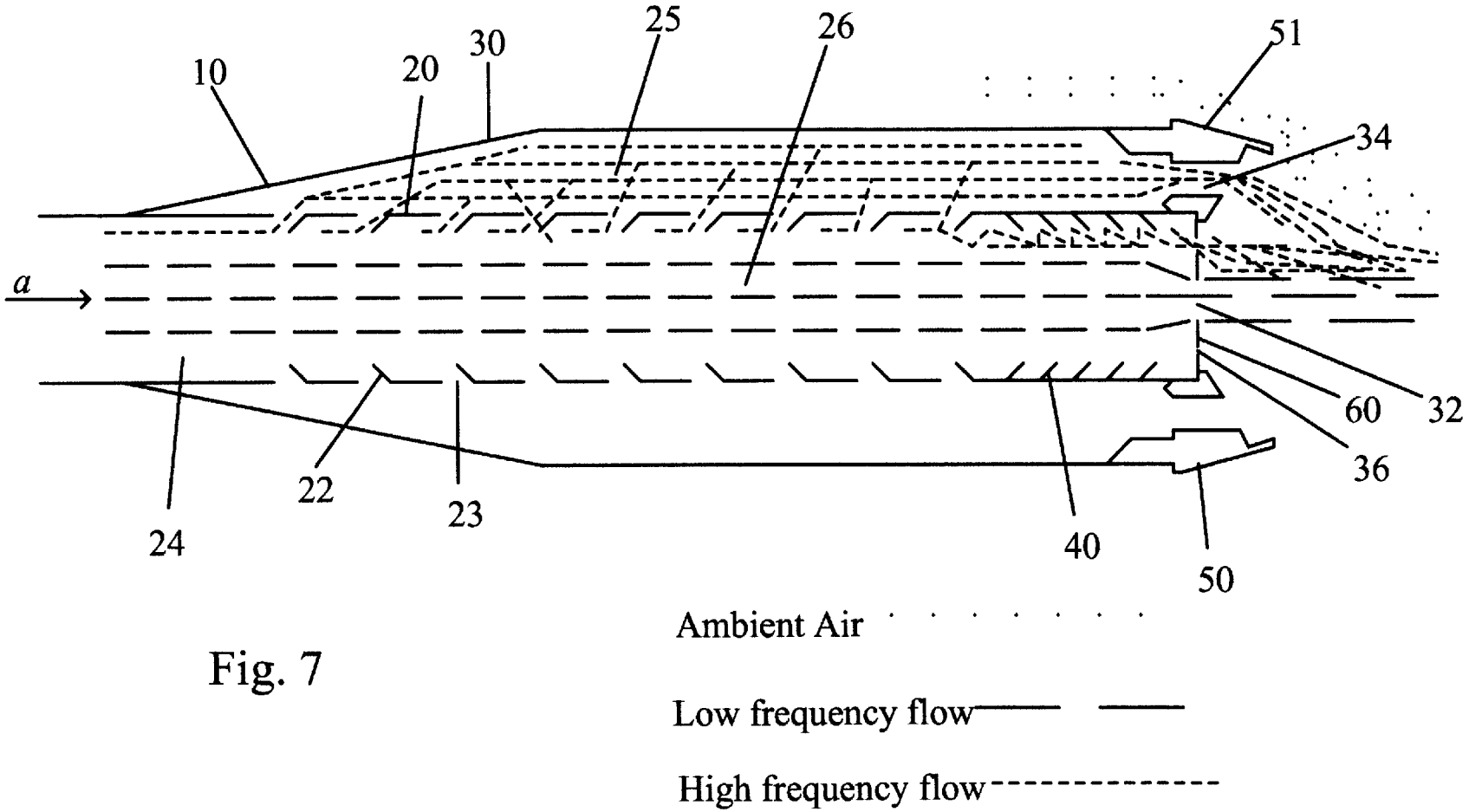
FIG. 7 shows a partial sectional view of the embodiment of FIG. 3 used to explain the exhaust flow within the muffler.

Referring to FIG. 7, the flow of gasses in muffler 10 is shown. The low frequency portion flows substantially in the center of louver tube 10. High frequency portions stay near the outer wall of louver tube 20 and are scooped into outer tube 30 by the louvers 22 through the louver holes 23. The high frequency portions continue to the end of muffler 10 and exit through end cap holes 34. The ambient air from the slipstream is curved by surface 51 of end cap 50 and forces the high frequency portions exiting end cap holes 34 into the high frequency portions exiting louver tube 20 through restrictor disk holes 36. In turn, both high frequency portions are forced into the low frequency portion exiting louver tube 20 through exhaust exit hole 32. The result is a mellow tone from which most of the high frequencies are removed.

Turbulence is created within the entire muffler at lower rpms. This turbulence decreases as the rpms increase. At low rpms, the center flow at the exhaust end of muffler 10 does not provide any vacuum effect (Bernoulli effect) to the gasses flowing through end cap holes 34. As the rpms increase and internal turbulence decreases, the center flow through exhaust exit hole 32 smoothes out and causing a vacuum with respect to the gasses flowing through end cap holes 34. The greater the rpms, the greater the velocity of the exhaust gasses through exit hole 32 and the greater the vacuum effect on the outer holes with a consequent decrease in system backpressure. At high rpms, then, the exhaust system with muffler 10 is a high flow capacity system with outstanding mid and top range engine torque and horsepower. At low rpms, the system with muffler 10 has a controlled backpressure for increased torque and fuel economy.

Figure 8:
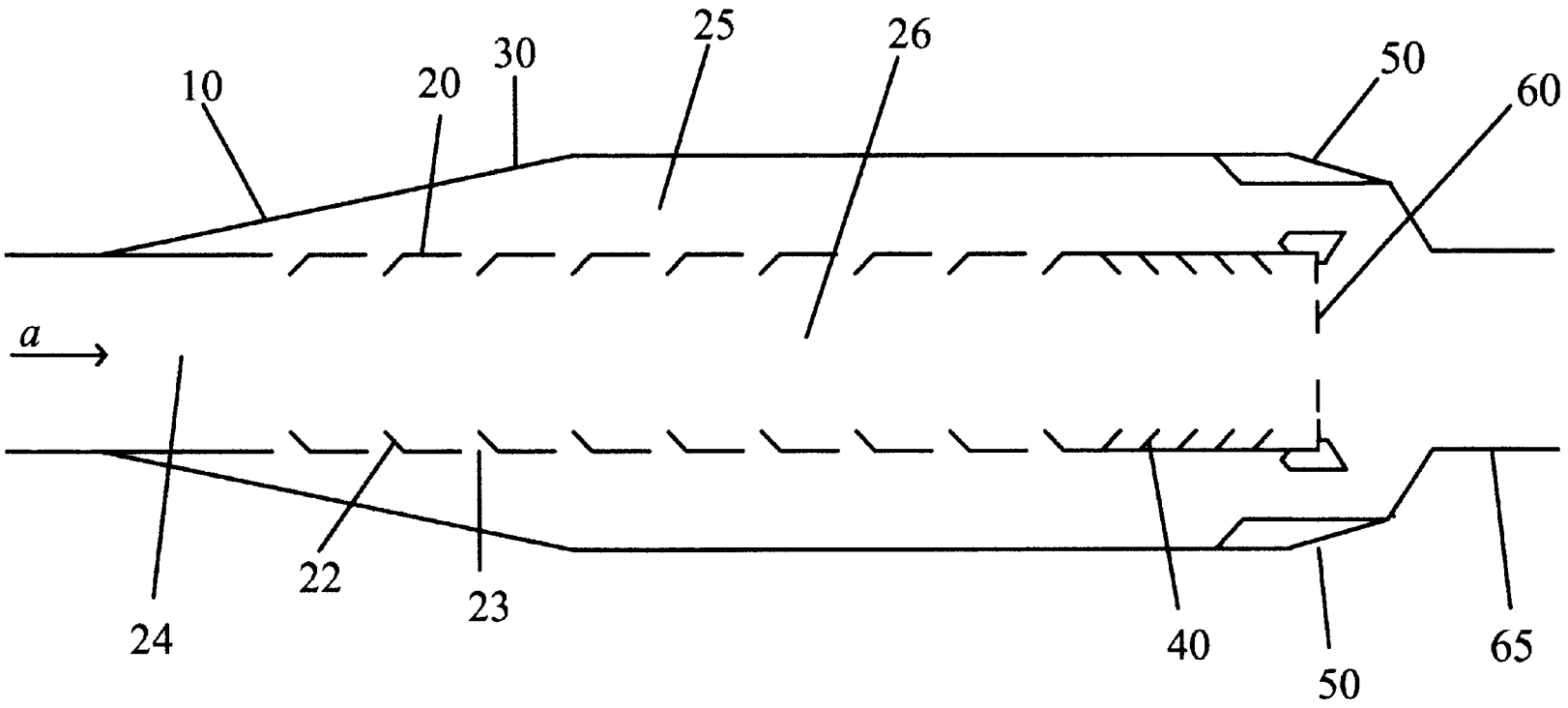
FIG. 8 shows an embodiment of the present invention adapted to fit between an exhaust pipe and a tailpipe.

Referring to FIG. 8, an embodiment of muffler 10 is adapted as an in-line muffler in an exhaust system. End cap 50 is modified to connect to a tailpipe 65. The illustration shows only one variation of the connection; other connections and angles between end cap 50 and tailpipe 65 are considered to be within the capability of one skilled in the art. Restrictor disk 60 is still used. As stated with respect to above embodiments, the exact size, shape, and placement of disk holes 36 and end cap holes 34 depends on the performance characteristics required.

Accordingly, it is to be understood that the embodiments of the invention herein described are merely illustrative of the application of the principles of the invention. Reference herein to details of the illustrated embodiments are not intended to limit the scope of the claims, which themselves recite those features regarded as essential to the invention.

What is claimed is:

1. An exhaust muffler for a motor vehicle, comprising:

a) a louver tube having an intake end and an exhaust end;

b) an outer tube concentrically arranged around said louver tube, said outer tube including a frustoconical portion and a cylindrical portion, said frustoconical portion connecting to said louver tube at said intake end such that a smallest cross-sectional area of said frustoconical portion is adjacent said intake end and a largest cross-sectional area of said frustoconical portion is adjacent said cylindrical portion;

c) a plurality of louvers and associated louver holes in said louver tube whereby a portion of gasses entering said louver tube are scooped into said outer tube by said louvers through said louver holes; and d) an end cap fitting into an exhaust end of said outer tube; said end cap having i) an exhaust exit hole in a center therein whereby gasses leaving said exhaust end of said louver tube flow through said exhaust exit hole, and ii) at least one end cap hole therein whereby gasses leaving said outer tube flow through said at least one end cap hole, wherein an exhaust flow from said vehicle is separated into first and second portions at an entry point of said muffler, and said first and second portions of said exhaust flow are combined downstream in said muffler.

2. An exhaust muffler according to claim 1, further comprising:

a spiral vane defining a helical passage around said louver tube and inside said outer tube; and at least one fin on said spiral vane extending orthogonal to an axis of said louver tube.

3. An exhaust muffler according to claim 2, wherein:

said spiral vane begins downstream of a first louver hole, said first louver hole being closest of all of said louver holes to said intake end of said louver tube; and said spiral vane ends downstream of a last louver hole, said last louver hole being closest of all of said louver holes to said exhaust end of said louver tube.

4. An exhaust muffler according to claim 1, further comprising at least one inner reverse cone inside said louver tube upstream of said exhaust end of said louver tube.

5. An exhaust muffler according to claim 1, wherein said motor vehicle is an automobile powered by one of an internal combustion engine or a turbo-charged diesel engine.

6. An exhaust muffler according to claim 1, wherein said motor vehicle is a motorcycle.

7. An exhaust muffler according to claim 1, wherein said motor vehicle is a truck powered by one of an internal combustion engine or a diesel engine.

8. An exhaust muffler according to claim 1, wherein said motor vehicle is a piece of heavy equipment powered by a diesel engine.

9. An exhaust muffler according to claim 1, wherein said louver tube is shaped as a cylinder and said cylindrical portion of said outer tube is congruent to said louver tube.

10. An exhaust muffler according to claim 1, further comprising:

(e) a spiral vane defining a helical passage around said louver tube and inside said outer tube.

11. An exhaust muffler according to claim 1, further comprising:

(e) at least one inner reverse cone inside said louver tube upstream of said exhaust end of said louver tube.

12. An exhaust muffler for a motor vehicle, comprising:

a) a louver tube having an intake end and an exhaust end;

b) an outer tube concentrically arranged around said louver tube, said outer tube including a frustoconical portion and a cylindrical portion, said frustoconical portion connecting to said louver tube at said intake end such that a smallest cross-sectional area of said frustoconical portion is adjacent said intake end and a largest cross-sectional area of said frustoconical portion is adjacent said cylindrical portion;

c) a plurality of louvers and associated louver holes in said louver tube whereby a portion of gasses entering said louver tube are scooped into said outer tube by said louvers through said louver holes; and d) an end cap fitting into an exhaust end of said outer tube; said end cap having at least one end cap hole therein whereby gasses leaving said outer tube flow through said at least one end cap hole, wherein an exhaust flow from said vehicle is separated into first and second portions at an entry point of said muffler, and said first and second portions of said exhaust flow are combined downstream in said muffler.

13. An exhaust muffler according to claim 12, wherein said end cap includes an exhaust exit hole in a center therein whereby gasses leaving said exhaust end of said louver tube flow through said exhaust exit hole.

14. An exhaust muffler according to claim 12, further comprising:

(e) a restrictor disk held against said exhaust end of said louver tube by said end cap, said restrictor disk having at least one hole therein.

15. An exhaust muffler according to claim 14, further comprising:

(f) at least one inner reverse cone inside said louver tube upstream of said exhaust end of said louver tube.

16. An exhaust muffler according to claim 12, further comprising:

(e) at least one inner reverse cone inside said louver tube upstream of said exhaust end of said louver tube.

* * * * *